US009951996B2

(12) United States Patent
Ishizaka

(10) Patent No.: US 9,951,996 B2
(45) Date of Patent: Apr. 24, 2018

(54) REFRIGERANT EVAPORATOR

(71) Applicant: DENSO CORPORATION, Kariya, Aichi-pref. (JP)

(72) Inventor: Naohisa Ishizaka, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 96 days.

(21) Appl. No.: 14/889,504

(22) PCT Filed: May 9, 2014

(86) PCT No.: PCT/JP2014/002452
§ 371 (c)(1),
(2) Date: Nov. 6, 2015

(87) PCT Pub. No.: WO2014/181546
PCT Pub. Date: Nov. 13, 2014

(65) Prior Publication Data
US 2016/0097597 A1 Apr. 7, 2016

(30) Foreign Application Priority Data
May 10, 2013 (JP) ..... 2013-100486

(51) Int. Cl.
*F25B 39/02* (2006.01)
*F28D 1/04* (2006.01)
(Continued)

(52) U.S. Cl.
CPC ..... *F28D 1/0443* (2013.01); *F25B 39/02* (2013.01); *F25B 39/028* (2013.01);
(Continued)

(58) Field of Classification Search
CPC . F25B 39/02; F25B 39/028; F28F 9/02; F28F 9/262; F28F 9/0243; F28D 1/0435;
(Continued)

(56) References Cited

U.S. PATENT DOCUMENTS 5,906,237 A * 5/1999 Aikawa ..... F25B 39/022 165/153
2004/0206490 A1 10/2004 Katoh et al.
(Continued)

FOREIGN PATENT DOCUMENTS

JP 2004347162 A 12/2004
JP 2006029697 A 2/2006
(Continued)

OTHER PUBLICATIONS

International Search Report and Written Opinion (in Japanese with English Translation) for PCT/JP2014/002452, dated Aug. 5, 2014; ISA/JP.

*Primary Examiner* — Frantz Jules
*Assistant Examiner* — Joseph Trpisovsky
(74) *Attorney, Agent, or Firm* — Harness, Dickey & Pierce, P.L.C.

(57) ABSTRACT

In a refrigerant evaporator, a first refrigerant collector defined in a tank portion of a first evaporation unit is connected to a second refrigerant distributor defined in a tank portion of a second evaporation unit, and a second refrigerant collector defined in the tank portion of the first evaporation unit is connected to a first refrigerant distributor defined in the tank portion of the second evaporation unit. The refrigerant evaporator includes a connection channel to connect a first refrigerant channel that introduces refrigerant from a heat-exchange core portion of the first evaporation unit to a heat-exchange core portion of the second evaporation unit and a second refrigerant channel that introduces refrigerant from a heat-exchange core portion of the second evaporation unit to a heat-exchange core portion of the first evaporation unit.

7 Claims, 9 Drawing Sheets

(51) Int. Cl.

| | |
|---|---|
| ***F28F 9/26*** | (2006.01) |
| ***F28D 1/053*** | (2006.01) |
| *F28F 9/02* | (2006.01) |
| *F28D 21/00* | (2006.01) |

(52) U.S. Cl.
CPC ..... *F28D 1/0435* (2013.01); *F28D 1/0452* (2013.01); *F28D 1/05333* (2013.01); *F28D 1/05375* (2013.01); *F28D 1/05391* (2013.01); *F28F 9/02* (2013.01); *F28F 9/262* (2013.01); *F28D 2021/0085* (2013.01); *F28F 9/0243* (2013.01)

(58) Field of Classification Search
CPC ..... F28D 1/05391; F28D 1/0443; F28D 1/05333; F28D 1/0452; F28D 1/05375; F28D 2021/0085
USPC ..... 62/524–526; 165/143, 144, 150, 153, 165/173, 174
See application file for complete search history.

(56) References Cited

U.S. PATENT DOCUMENTS

| | | | |
|---|---|---|---|
| 2005/0235691 | A1 | 10/2005 | Katoh et al. |
| 2007/0074861 | A1 | 4/2007 | Higashiyama |
| 2015/0027163 | A1 | 1/2015 | Ishizaka et al. |

FOREIGN PATENT DOCUMENTS

| | | | |
|---|---|---|---|
| JP | 2006284134 | A | 10/2006 |
| JP | 4024095 | B2 | 12/2007 |
| JP | 4124136 | B2 | 7/2008 |
| JP | 4207855 | B2 | 1/2009 |
| JP | 4554144 | B2 | 9/2010 |
| JP | 4625687 | B2 | 2/2011 |
| WO | WO-2014181550 | A1 | 11/2014 |

* cited by examiner

REFRIGERANT EVAPORATOR

CROSS REFERENCE TO RELATED APPLICATIONS

This application is a U.S. National Phase Application under 35 U.S.C. 371 of International Application No. PCT/JP2014/002452 filed on May 9, 2014 and published in Japanese as WO 2014/181546 A1 on Nov. 13, 2014. This application is based on and claims the benefit of priority from Japanese Patent Application No. 2013-100486 filed on May 10, 2013. The entire disclosures of all of the above applications are incorporated herein by reference.

TECHNICAL FIELD

The present disclosure relates to a refrigerant evaporator.

BACKGROUND ART

A refrigerant evaporator functions as a cooling heat exchanger that cools fluid (for example, air) flowing outside by evaporating refrigerant (liquid phase refrigerant) flowing inside to absorb heat from the fluid.

A refrigerant evaporator includes first and second evaporation units, each of which has a heat-exchanging core portion formed by stacking multiple tubes and a pair of tank portions connected to both ends of the multiple tubes. The first and second evaporation units are disposed in series in a flow direction of the fluid, and first tank portions of the respective evaporation units are coupled to each other via communication portions (see, for example, PTL 1).

The refrigerant evaporator of PTL 1 is configured in such a manner that when refrigerant that has flowed the heat-exchanging core portion of the first evaporation unit is made to flow into the heat-exchanging core portion of the second evaporation unit via the first tank portions of the respective evaporation units and a pair of the communication portions coupling the first tank portions, flows of the refrigerant are interchanged in a width direction (right-left direction) of the heat-exchanging core portions. In other words, the refrigerant evaporator is configured in such a manner that the refrigerant flowing the heat-exchanging core portion of the first evaporation unit on one side in the width direction is made to flow into the heat-exchanging core portion of the second evaporator portion on the other side in the width direction using one of the pair of communication portions, while the refrigerant flowing the heat-exchanging core portion of the first evaporation unit on the other side in the width direction is made to flow into the heat-exchanging core portion of the second evaporation unit on the one side in the width direction using the other communication portion.

PRIOR ART LITERATURES

Patent Literature

PTL 1: JP 4124136 B2

SUMMARY OF INVENTION

Besides a refrigerant, refrigerator oil to supply lubrication for a compressor is sealed in a refrigerating cycle, and a part of the refrigerator oil circulates in the cycle with the refrigerant. In the refrigerating cycle provided with the refrigerant evaporator described in PTL 1, a part of the refrigerator oil may possibly stagnate in the refrigerant evaporator during a continuous operation at which a flow rate of the refrigerant circulating in the cycle is low.

The present disclosure has an object to provide a refrigerant evaporator capable of securing a flow rate of refrigerator oil circulating in a refrigerating cycle and also restricting deterioration of refrigerant distribution immediately after a compressor is activated.

According to an aspect of the present disclosure, a refrigerant evaporator includes a first evaporation unit and a second evaporation unit disposed in series in a flow direction of fluid to be cooled. Each of the first evaporation unit and the second evaporation unit has a heat-exchanging core portion in which a plurality of tubes are stacked, and the refrigerant flows through the plurality of tubes. The heat-exchanging core portion of the first evaporation unit has a first core portion defined by a part of the plurality of tubes and a second core portion defined by a rest of the plurality of tubes. The heat-exchanging core portion of the second evaporation unit has a third core portion defined by a part of the plurality of tubes opposing at least a part of the first core portion in the flow direction of the fluid and a fourth core portion defined by a part of the plurality of tubes opposing at least a part of the second core portion in the flow direction of the fluid. The refrigerant evaporator further includes a connection channel to connect a first refrigerant channel that introduces refrigerant from the first core portion to the fourth core portion and a second refrigerant channel that introduces refrigerant from the second core portion to the third core portion.

According to the configuration as above, by providing the connection channel connecting the first refrigerant channel that introduces refrigerant from the first core portion to the fourth core portion and the second refrigerant channel that introduces refrigerant from the second core portion to the third core portion, liquid phase refrigerant is able to move between the first refrigerant channel (adjacent to the fourth core portion) and the second refrigerant channel (adjacent to the third core portion) via the connection channel.

Hence, liquid phase refrigerant moves between the first refrigerant channel and the second refrigerant channel from one refrigerant channel where a flow rate of the refrigerant is high to the other refrigerant channel where a flow rate of the refrigerant is low via the connection channel. Accordingly, a flow rate of the refrigerant flowing the other refrigerant channel where a flow rate of the refrigerant is low increases and refrigerator oil stagnating in the refrigerant channel where a flow rate of the refrigerant is low can be flushed (forced to migrate) by the liquid phase refrigerant. Consequently, the refrigerator oil can be restricted from stagnating in the refrigerant evaporator and hence a flow rate of the refrigerator oil circulating in the refrigeration cycle can be secured.

By providing the connection channel connecting the first refrigerant channel that introduces refrigerant from the first core portion to the fourth core portion and the second refrigerant channel that introduces refrigerant from the second core portion to the third core portion, liquid phase refrigerant stagnating in the refrigerant evaporator is able to migrate between the first refrigerant channel and the second refrigerant channel via the connection channel when an operation of a compressor is stopped. Hence, an amount of the refrigerant remaining in the first refrigerant channel and an amount of the refrigerant remaining in the second refrigerant channel become equal.

Consequently, flow rates of the refrigerant flowing the fourth core portion and the third core portion become equal immediately after the compressor is activated, and deterioration of refrigeration distribution immediately after activation of the compressor can be restricted.

DESCRIPTION OF EMBODIMENTS

An embodiment of the present disclosure will be described using FIG. 1 through FIG. 9. A refrigerant evaporator 1 of the present embodiment is a cooling heat exchanger which is applied to a vapor compression refrigerating cycle in an air conditioner for a vehicle to adjust a temperature in the vehicle interior and cools blown air to be blown into the vehicle interior by absorbing heat from the blown air and letting refrigerant (liquid phase refrigerant) evaporate. In the present embodiment, the blown air corresponds to a fluid flowing outside to be cooled.

A refrigerating cycle is known to include a refrigerant evaporator as well as components unillustrated herein, such as a compressor, a radiator (condenser), and an expansion valve. In the present embodiment, the refrigerating cycle is formed as a receiver cycle in which a liquid receiver is disposed between the radiator and the expansion valve. The refrigerant in the refrigerating cycle is mixed with refrigerator oil to supply lubrication for the compressor, and a part of the refrigerator oil circulates in the cycle with the refrigerant.

Here, in FIG. 2, tubes 111, 211 and fins 112, 212 are not illustrated in each heat-exchanging core portion 11, 21 to be described below.

Figure 1:
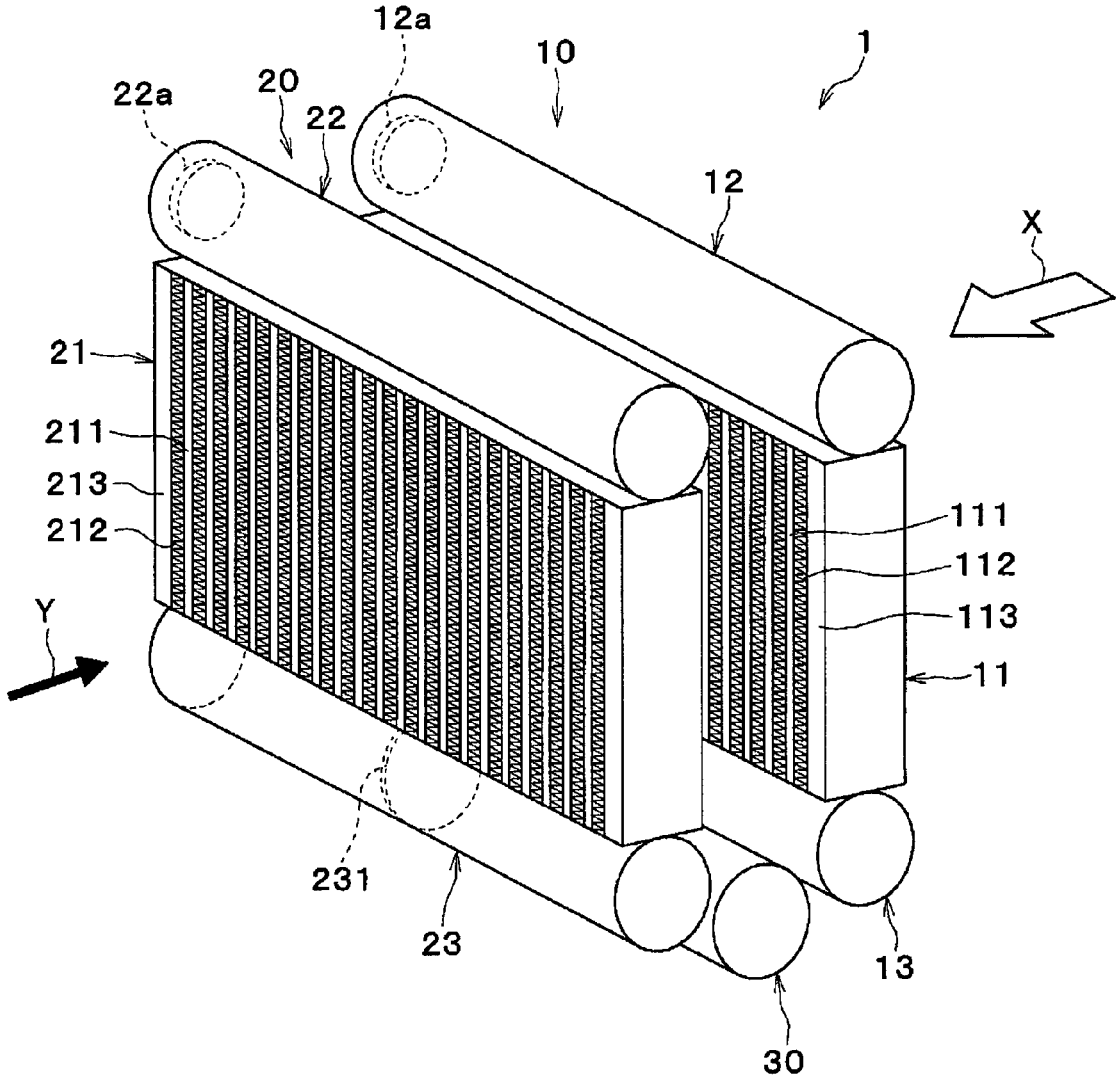
FIG. 1 is a schematic perspective view of a refrigerant evaporator according to an embodiment of the present disclosure.
Figure 2:
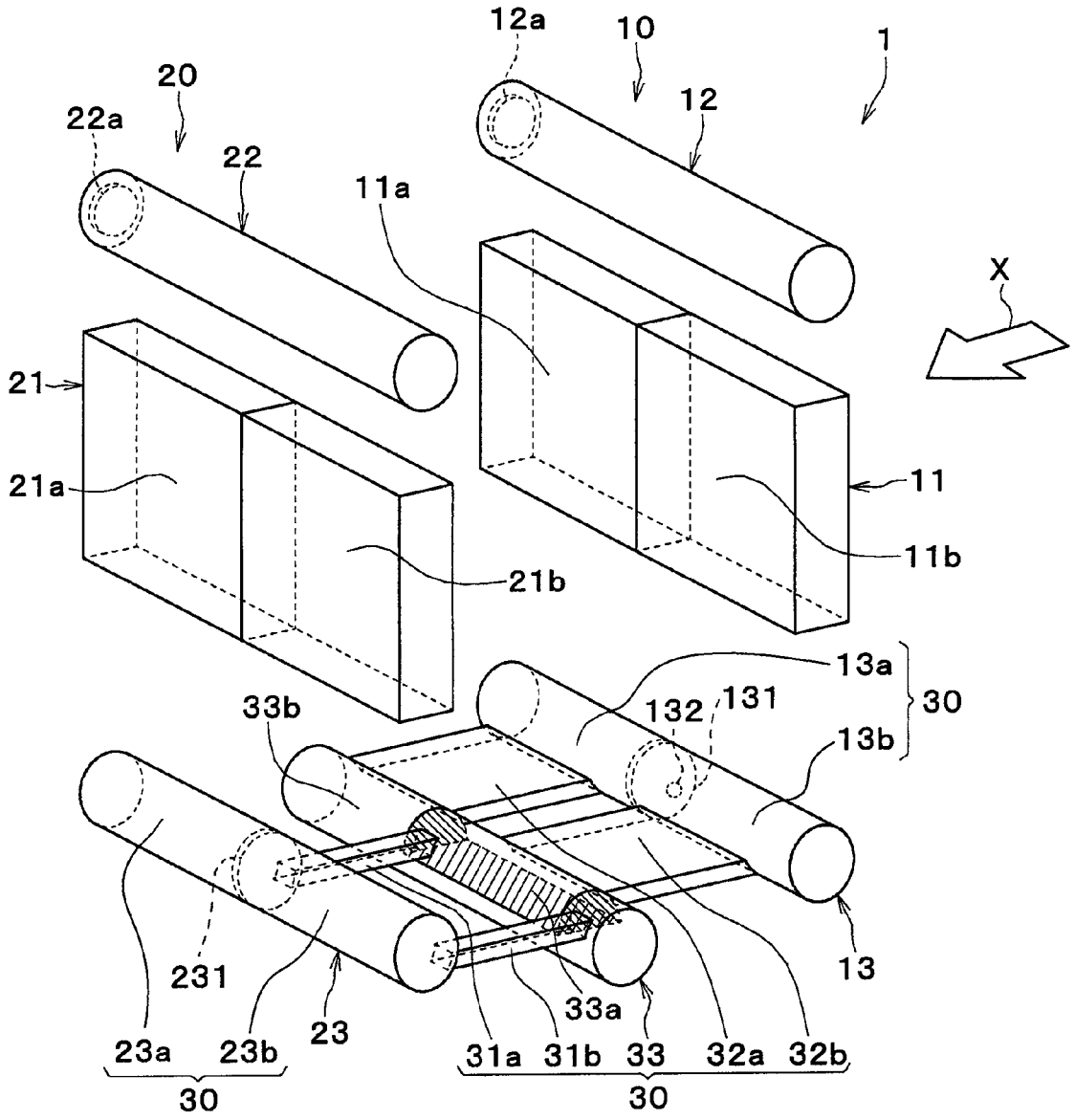
FIG. 2 is an exploded perspective view of the refrigerant evaporator shown in FIG. 1.

As shown in FIG. 1 and FIG. 2, the refrigerant evaporator 1 of the present embodiment includes two evaporation units 10 and 20 disposed in series in a flow direction of blown air (a flow direction of the fluid) X. In the present embodiment, one of the two evaporation units 10 and 20 disposed on a windward side (upstream side) in the flow direction X of blown air is referred to as the windward evaporation unit 10, and the other evaporation unit disposed on a leeward side (downstream side) in the flow direction X of blown air is referred to as the leeward evaporation unit 20. The windward evaporation unit 10 corresponds to a second evaporation unit, and the leeward evaporation unit 20 corresponds to a first evaporation unit, in the present embodiment.

The windward evaporation unit 10 and the leeward evaporation unit 20 are of a same fundamental structure. The windward evaporation unit 10 has a heat-exchanging core portion 11 and a pair of tank portions 12 and 13 disposed, respectively, on upper and lower sides of the heat-exchanging core portion 11. The leeward evaporation unit 20 has a heat-exchanging core portion 21 and a pair of tank portions 22 and 23 disposed, respectively, on upper and lower sides of the heat-exchanging core portion 21.

In the present embodiment, the heat-exchanging core portion of the windward evaporation unit 10 is referred to as the windward heat-exchanging core portion 11 and the heat-exchanging core portion of the leeward evaporation unit 20 is referred to as the leeward heat-exchanging core portion 21. In a pair of the tank portions 12 and 13 of the windward evaporation unit 10, the tank portion disposed on the upper side is referred to as the first windward tank portion 12 and the tank portion disposed on the lower side is referred to as the second windward tank portion 13. Likewise, in a pair of the tank portions 22 and 23 of the leeward evaporation unit 20, the tank portion disposed on the upper side is referred to as the first leeward tank portion 22 and the tank portion disposed on the lower side is referred to as the second leeward tank portion 23.

The windward heat-exchanging core portion 11 and the leeward heat-exchanging core portion 21 of the present embodiment are formed of stacked bodies. The windward heat-exchanging core portion 11 is formed by alternately stacking multiple tubes 111 extending in a top-to-bottom direction and fins 112 bonded between the adjacent tubes 111. The leeward heat-exchanging core portion 21 is formed by alternately stacking multiple tubes 211 extending in the top-to-bottom directions and fins 212 bonded between the adjacent tubes 211. Hereinafter, a stacking direction of the stacked bodies formed of the multiple tubes 111, 211 and the fins 112, 212 is referred to as the tube stacking direction.

The windward heat-exchanging core portion 11 has a first windward heat-exchanging core portion 11*a* defined by a part of tube groups of the multiple tubes 111 and a second windward heat-exchanging core portion 11*b* defined by the rest of the tube groups of the multiple tubes 111. The first windward heat-exchanging core portion 11*a* corresponds to a third core portion, and the second windward heat-exchanging core portion 11*b* corresponds to a fourth core portion, in the present embodiment.

In the present embodiment, when the windward heat-exchanging core portion 11 is viewed in the flow direction of blown air, the first windward heat-exchanging core portion 11*a* is defined by tube groups on a right side in the tube stacking direction while the second windward heat-exchanging core portion 11*b* is defined by the tube groups on a left side in the tube stacking direction.

Also, the leeward heat-exchanging core portion 21 has a first leeward heat-exchanging core portion 21*a* defined by a part of tube groups of the multiple tubes 211 and a second leeward heat-exchanging core portion 21*b* defined by the rest of the tube groups of the multiple tubes 211. The first leeward heat-exchanging core portion 21*a* corresponds to a first core portion, and the second leeward heat-exchanging core portion 21*b* corresponds to a second core portion, in the present embodiment.

In the present embodiment, when the leeward heat-exchanging core portion 21 is viewed in the flow direction of blown air, the first leeward heat-exchanging core portion 21*a* is defined by tube groups on a right side in the tube stacking direction while the second leeward heat-exchanging core portion 21*b* is defined by the tube groups on a left side in the tube stacking direction. In the present embodiment, when viewed in the flow direction of blown air, the first windward heat-exchanging core portion 11*a* and the first leeward heat-exchanging core portion 21*a* are disposed to overlap (oppose) with each other, while the second windward heat-exchanging core portion 11*b* and the second leeward heat-exchanging core portion 21*b* are disposed to overlap (oppose) with each other.

Each of the tubes 111, 211 is formed of a flat tube, inside of which a refrigerant passage is defined for the refrigerant to flow and which has a flat sectional shape extending along the flow direction of blown air.

The tubes 111 of the windward heat-exchanging core portion 11 are connected to the first windward tank portion 12 at one ends (upper ends) in a longitudinal direction and connected to the second windward tank portion 13 at the other ends (lower ends) in the longitudinal direction. Also, the tubes 211 of the leeward heat-exchanging core portion 21 are connected to the first leeward tank portion 22 at one ends (upper ends) in the longitudinal direction and connected to the second leeward tank portion 23 at the other ends (lower ends) in the longitudinal direction.

Each fin 112, 212 is a corrugate fin formed of a thin plate material folded in a wavy shape. The fins 112, 212 are bonded to flat outer surfaces of the respective tubes 111, 211 and function as heat-exchange facilitating member for increasing a heat-transfer area between the blown air and the refrigerant.

Side plates 113 to reinforce the respective heat-exchanging core portions 11 and 21 are disposed to the respective stacked bodies formed of the tubes 111, 211 and the fins 112, 212 at both ends in the tube stacking direction. The side plates 113 are bonded to the fins 112, 212 disposed on outermost sides in the tube stacking direction.

The first windward tank portion 12 is formed of a tube-like member which is closed at one end (a left end when viewed in the flow direction of blown air) and provided with a refrigerant outlet portion 12*a* at the other end (a right end when viewed in the flow direction of blown air). The refrigerant outlet portion 12*a* is to introduce the refrigerant in the tank to a drawing side of the compressor (not shown). The first windward tank portion 12 has through-holes (not shown) in a bottom portion for the one ends (upper ends) of the respective tubes 111 to be inserted and bonded. In other words, the first windward tank portion 12 is formed in such a manner that an internal space communicates with the respective tubes 111 of the windward heat-exchanging core portion 11, and functions as a refrigerant collection portion that collects the refrigerant from the respective core portions 11*a* and 11*b* of the windward heat-exchanging core portion 11.

The first leeward tank portion 22 is formed of a tube-like member which is closed at one end and provided with a refrigerant inlet portion 22*a* at the other end. The refrigerant inlet portion 22*a* is to introduce the low-pressure refrigerant decompressed at the expansion valve (not shown) into the tank portion. The first leeward tank portion 22 has through-holes (not shown) in a bottom portion for the one ends (upper ends) of the respective tubes 211 to be inserted and bonded. In other words, the first leeward tank portion 22 is formed in such a manner that an internal space communicates with the respective tubes 211 of the leeward heat-exchanging core portion 21, and functions as a refrigerant distribution portion that distributes the refrigerant to the respective core portions 21*a* and 21*b* of the leeward heat-exchanging core portion 21.

The second windward tank portion 13 is formed of a tube-like member closed at both ends. The second windward tank portion 13 has through-holes (not shown) in a ceiling portion for the other ends (lower ends) of the respective tubes 111 to be inserted and bonded. In other words, the second windward tank portion 13 is formed in such a manner that an internal space communicates with the respective tubes 111.

A partition member 131 is disposed inside the second windward tank portion 13 at a center position in the longitudinal direction. The partition member 131 divides the tank internal space to a space with which the respective tubes 111 making up the first windward heat-exchanging core portion 11*a* communicate, and another space with which the respective tubes 111 making up the second windward heat-exchanging core portion 11*b* communicate.

In the interior of the second windward tank portion 13, the space communicating with the respective tubes 111 making up the first windward heat-exchanging core portion 11*a* forms a first refrigerant distribution portion 13*a* that distributes the refrigerant to the first windward heat-exchanging core portion 11*a*, and the space communicating with the respective tubes 111 making up the second windward heat-exchanging core portion 11*b* forms a second refrigerant distribution portion 13*b* that distributes the refrigerant to the second windward heat-exchanging core portion 11*b*.

The second leeward tank portion 23 is formed of a tube-like member closed at both ends. The second leeward tank portion 23 has through-holes (not shown) in a ceiling portion for the other ends (lower ends) of the respective tubes 211 to be inserted and bonded. In other words, the second leeward tank portion 23 is formed in such a manner that an internal space communicates with the respective tubes 211.

A partition member 231 is disposed inside the second leeward tank portion 23 at a center position in the longitudinal direction. The partition member 231 divides the tank internal space to a space with which the respective tubes 211 making up the first leeward heat-exchanging core portion 21*a* communicate, and another space with which the respective tubes 211 making up the second leeward heat-exchanging core portion 21*b* communicate.

In the interior of the second leeward tank portion 23, the space communicating with the respective tubes 211 making up the first leeward heat-exchanging core portion 21*a* forms a first refrigerant collection portion 23*a* that collects the refrigerant from the first leeward heat-exchanging core portion 21*a*, and the space communicating with the respective tubes 211 making up the second leeward heat-exchanging core portion 21*b* forms a second refrigerant collection portion 23*b* that collects the refrigerant from the second leeward heat-exchanging core portion 21*b*.

The second windward tank portion 13 and the second leeward tank portion 23 coupled to each other via a refrigerant interchanging portion 30. The refrigerant interchanging portion 30 is configured so as to introduce the refrigerant in the first refrigerant collection portion 23*a* of the second leeward tank portion 23 to the second refrigerant distribution portion 13*b* of the second windward tank portion 13 and also to introduce the refrigerant in the second refrigerant collection portion 23*b* of the second leeward tank portion 23 to the first refrigerant distribution portion 13*a* of the second windward tank portion 13. In short, the refrigerant interchanging portion 30 is configured so as to interchange flows of the refrigerant in the core width direction in the respective heat-exchanging core portions 11 and 21.

More specifically, the refrigerant interchanging portion 30 is formed of a pair of collection connectors 31*a* and 31*b* which are coupled, respectively, to the first and second refrigerant collection portions 23*a* and 23*b* of the second leeward tank portion 23, a pair of distribution connectors 32*a* and 32*b* which are coupled, respectively, to the refrigerant distribution portions 13*a* and 13*b* of the second windward tank portion 13, and an intermediate tank portion 33 coupled to each of the collection connectors 31*a* and 31*b* and each of the distribution connectors 32*a* and 32*b*.

Each of the collection connectors 31*a* and 31*b* in a pair is formed of a tube-like member, within which a refrigerant channel to pass the refrigerant is defined. One end of each is connected to the second leeward tank portion 23 and the other end is connected to the intermediate tank portion 33.

One of the collection connectors 31*a* and 31*b* is referred to as a first collection connector 31*a*, which is connected to the second leeward tank portion 23 at one end so as to communicate with the first refrigerant collection portion 23*a* and connected to the intermediate tank portion 33 at the other end so as to communicate with a first refrigerant channel 33*a* in the intermediate tank portion 33 described below.

The other one is referred to as a second collection connector 31*b*, which is connected to the second leeward tank portion 23 at one end so as to communicate with the second refrigerant collection portion 23*b* and connected to the intermediate tank portion 33 at the other end so as to communicate with a second refrigerant channel 33*b* in the intermediate tank portion 33 described below.

In the present embodiment, the one end of the first collection connector 31*a* is connected to the first refrigerant collection portion 23*a* at a position nearer to the partition member 231 and the one end of the second collection connector 31*b* is connected to the second refrigerant collection portion 23*b* at a position nearer to the closed end of the second leeward tank portion 23.

Each of the distribution connectors 32*a* and 32*b* in a pair is formed of a tube-like member, within which a refrigerant channel to pass the refrigerant is defined. One end of each is connected to the second windward tank portion 13 and the other end is connected to the intermediate tank portion 33.

One of the distribution connectors 32*a* and 32*b* is referred to as a first distribution connector 32*a*, which is connected to the second windward tank portion 13 at one end so as to communicate with the first refrigerant distribution portion 13*a* and connected to the intermediate tank portion 33 at the other end so as to communicate with the second refrigerant channel 33*b* in the intermediate tank portion 33 described below. In short, the first distribution connector 32*a* communicates with the second collection connector 31*b* via the second refrigerant channel 33*b* in the intermediate tank portion 33.

The other one is referred to as a second distribution connector 32*b*, which is connected to the second windward tank portion 13 at one end so as to communicate with the second refrigerant distribution portion 13*b* and connected to the intermediate tank portion 33 at the other end so as to communicate with the first refrigerant channel 33*a* in the intermediate tank portion 33 described below. In short, the second distribution connector 32*b* communicates with the first collection connector 31*a* via the first refrigerant channel 33*a* in the intermediate tank portion 33.

In the present embodiment, the one end of the first distribution connector 32*a* is connected to the first refrigerant distribution portion 13*a* at a position nearer to the closed end of the second windward tank portion 13 and the one end of the second distribution connector 32*b* is connected to the second refrigerant distribution portion 13*b* at a position nearer to the partition member 131.

Each of the collection connectors 31*a* and 31*b* in a pair configured as above forms a refrigerant inlet port of the refrigerant interchanging portion 30 whereas each of the distribution connectors 32*a* and 32*b* in a pair forms a refrigerant outlet port of the refrigerant interchanging portion 30.

The intermediate tank portion 33 is formed of a tube-like member closed at both ends. The intermediate tank portion 33 is disposed between the second windward tank portion 13 and the second leeward tank portion 23. More specifically, when viewed in the flow direction X of blown air, a part (upper region) of the intermediate tank portion 33 overlaps the second windward tank portion 13 and the second leeward tank portion 23 while another part (lower region) of the intermediate tank portion 33 does not overlap the second windward tank portion 13 and the second leeward tank portion 23.

When configured in such a manner as above that a part of the intermediate tank portion 33 does not overlap the second windward tank portion 13 and the second leeward tank portion 23, the first evaporation unit 10 and the second evaporation unit 20 can be disposed in close proximity to each other in the flow direction X of blown air. Hence, an increase of a physical size of the refrigerant evaporator 1 caused by providing the intermediate tank portion 33 can be restricted.

Figure 3:
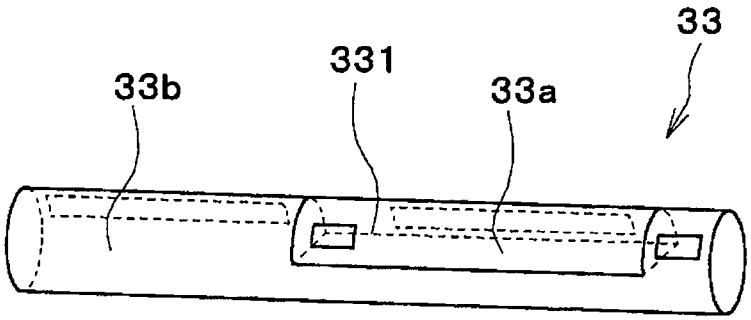
FIG. 3 is a schematic perspective view of an intermediate tank portion according to the embodiment.
Figure 4:
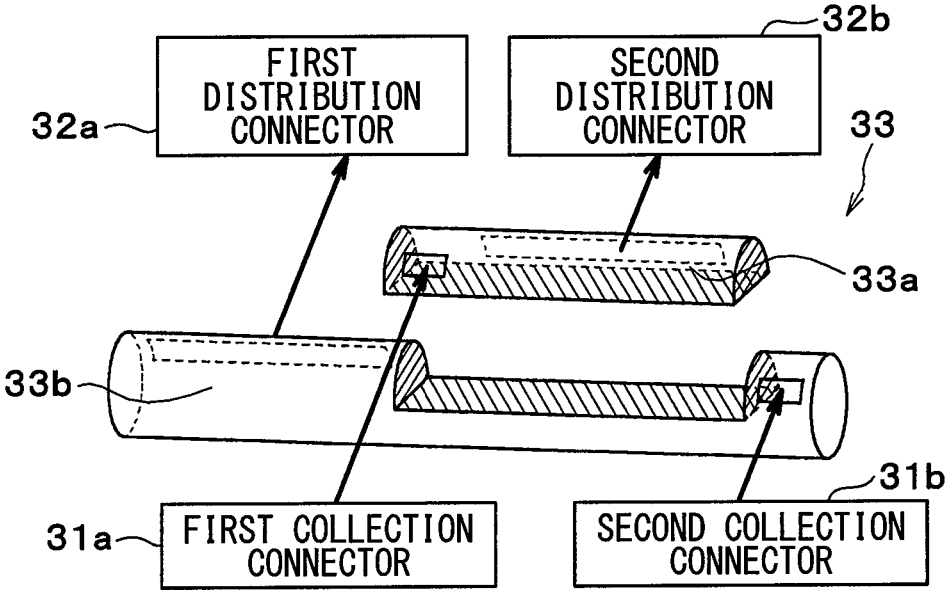
FIG. 4 is an exploded perspective view of the intermediate tank portion shown in FIG. 3.

As shown in FIG. 3 and FIG. 4, a partition member 331 is disposed inside the intermediate tank portion 33 in a region positioned on an upper side. An internal space of the tank is divided by the partition member 331 to the first refrigerant channel 33*a* and the second refrigerant channel 33*b*.

The first refrigerant channel 33*a* forms a refrigerant channel that introduces the refrigerant from the first collection connector 31*a* to the second distribution connector 32*b*. Meanwhile, the second refrigerant channel 33*b* forms a refrigerant channel that introduces the refrigerant from the second collection connector 31*b* to the first distribution connector 32*a*.

In the present embodiment, the first collection connector 31*a*, the second distribution connector 32*b*, and the first refrigerant channel 33*a* in the intermediate tank portion 33 together form a first communication portion. Also, the second collection connector 31*b*, the first distribution connector 32*a*, and the second refrigerant channel 33*b* in the intermediate tank portion 33 together form a second communication portion.

Referring to FIG. 2 again, the partition member 131 in the second windward tank portion 13 has a through-hole 132 penetrating from one side to the other side. Owing to the through-hole 132, the first refrigerant distribution portion 13*a* and the second refrigerant distribution portion 13*b* communicate with each other. Hence, in the present embodiment, the through-hole 132 corresponds to a communication portion.

Flows of the refrigerant in the refrigerant evaporator 1 of the present embodiment will now be described with reference to FIG. 5.

Figure 5:
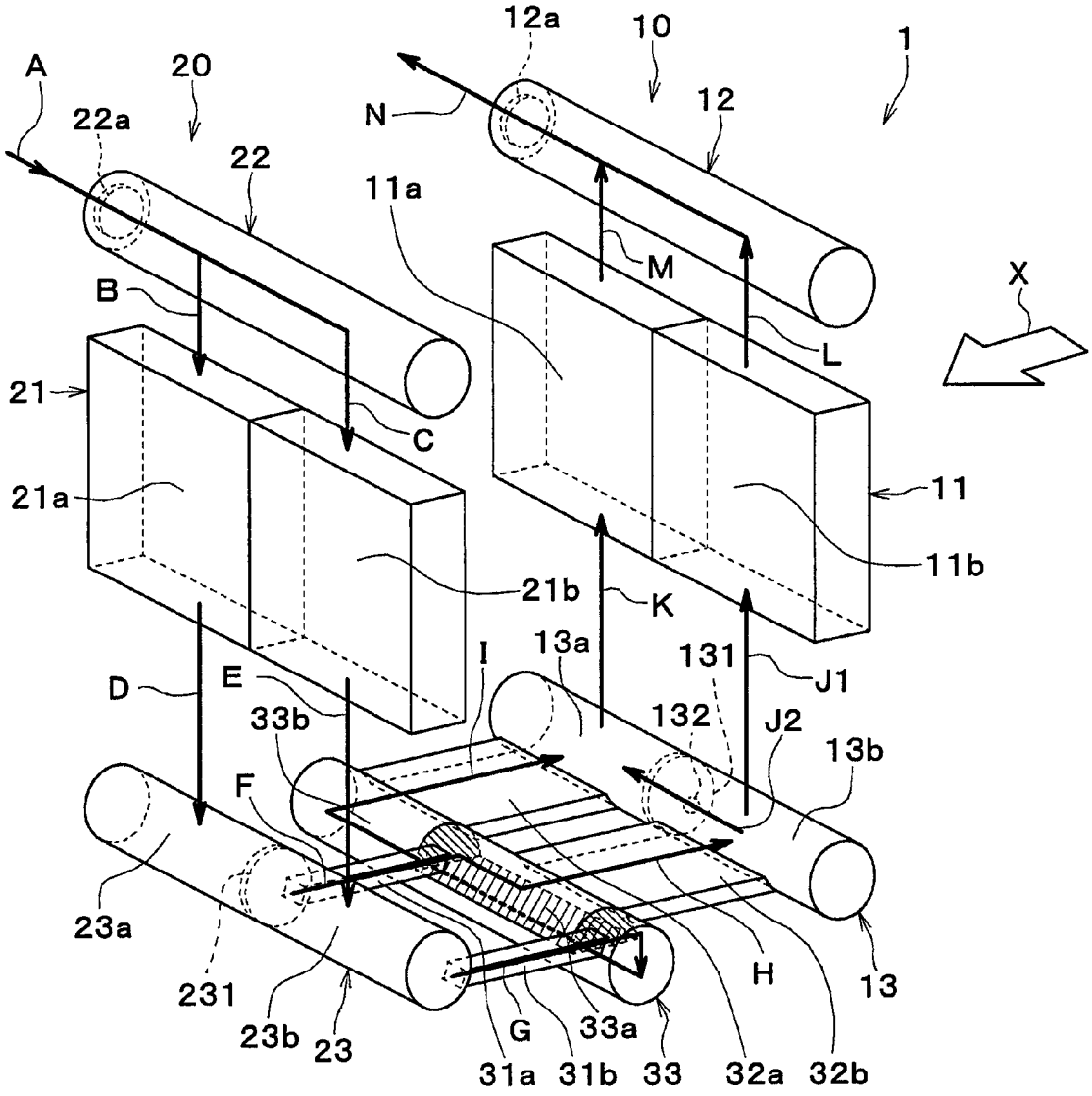
FIG. 5 is a view to describe flows of refrigerant in the refrigerant evaporator according to the embodiment.

As shown in FIG. 5, a low-pressure refrigerant decompressed at the expansion valve (not shown) is introduced as indicated by an arrow A from the refrigerant inlet portion 22*a* provided at one end of the first leeward tank portion 22 into the tank. The refrigerant introduced into the first leeward tank portion 22 flows down the first leeward heat-exchanging core portion 21*a* of the leeward heat-exchanging core portion 21 as indicated by an arrow B and also flows down the second leeward heat-exchanging core portion 21*b* of the leeward heat-exchanging core portion 21 as indicated by an arrow C.

The refrigerant that has flowed down the first leeward heat-exchanging core portion 21*a* flows into the first refrigerant collection portion 23*a* of the second leeward tank portion 23 as indicated by an arrow D. Meanwhile, the refrigerant that has flowed down the second leeward heat-exchanging core portion 21*b* flows into the second refrigerant collection portion 23*b* of the second leeward tank portion 23 as indicated by an arrow E.

The refrigerant that has flowed into the first refrigerant collection portion 23*a* flows into the first refrigerant channel 33*a* in the intermediate tank portion 33 via the first collection connector 31*a* as indicated by an arrow F. Also, the refrigerant that has flowed into the second refrigerant collection portion 23*b* flows into the second refrigerant channel 33*b* in the intermediate tank portion 33 via the second collection connector 31*b* as indicated by an arrow G.

The refrigerant that has flowed into the first refrigerant channel 33*a* flows into the second refrigerant distribution portion 13*b* of the second windward tank portion 13 via the second distribution connector 32*b* as indicated by an arrow H. Also, the refrigerant that has flowed into the second refrigerant channel 33*b* flows into the first refrigerant distribution portion 13*a* of the second windward tank portion 13 via the first distribution connector 32*a* as indicated by an arrow I.

Most of the refrigerant that has flowed into the second refrigerant distribution portion 13*b* of the second windward tank portion 13 flows up the second windward heat-exchanging core portion 11*b* of the windward heat-exchanging core portion 11 as indicated by an arrow J1. A part of the refrigerant that has flowed into the second refrigerant distribution portion 13*b* of the second windward tank portion 13 flows into the first refrigerant distribution portion 13*a* of the second windward tank portion 13 via the through-hole 132 as indicated by an arrow J2.

Meanwhile, the refrigerant that has flowed into the first refrigerant distribution portion 13*a* flows up the first windward heat-exchanging core portion 11*a* of the windward heat-exchanging core portion 11 as indicated by an arrow K.

The refrigerant that has flowed up the second windward heat-exchanging core portion 11*b* and the refrigerant that has flowed up the first windward heat-exchanging core portion 11*a* flow into the tank of the first windward tank portion 12 as indicated by arrows L and M, respectively. Subsequently, the refrigerants are introduced to a drawing side of the compressor (not shown) from the refrigerant outlet portion 12*a* provided at one end of the first windward tank portion 12 as indicated by an arrow N.

As has been described, the refrigerant from the first leeward heat-exchanging core portion 21*a* of the leeward heat-exchanging core portion 21 flows into the second windward heat-exchanging core portion 11*b* of the windward heat-exchanging core portion 11 via the first refrigerant collection portion 23*a* of the second leeward tank portion 23, the first collection connector 31*a*, the first refrigerant channel 33*a* in the intermediate tank portion 33, the second distribution connector 32*b*, and the second refrigerant distribution portion 13*b* of the second windward tank portion 13.

Hence, in the present embodiment, the first refrigerant collection portion 23*a*, the first collection connector 31*a*, the first refrigerant channel 33*a*, the second distribution connector 32*b*, and the second refrigerant distribution portion 13*b* together corresponds to a first refrigerant channel.

The refrigerant from the second leeward heat-exchanging core portion 21*b* of the leeward heat-exchanging core portion 21 flows into the first windward heat-exchanging core portion 11*a* of the windward heat-exchanging core portion 11 via the second refrigerant collection portion 23*b* of the second leeward tank portion 23, the second collection connector 31*b*, the second refrigerant channel 33*b* in the intermediate tank portion 33, the first distribution connector 32*a*, and the first refrigerant distribution portion 13*a* of the second windward tank portion 13.

Hence, in the present embodiment, the second refrigerant collection portion 23*b*, the second collection connector 31*b*, the second refrigerant channel 33*b*, the first distribution connector 32*a*, and the first refrigerant distribution portion 13*a* together corresponds to a second refrigerant channel.

In addition, "the first refrigerant channel" that introduces the refrigerant from the first leeward heat-exchanging core portion 21*a* to the second windward heat-exchanging core portion 11*b* and "the second refrigerant channel" that introduces the refrigerant from the second leeward heat-exchanging core portion 21*b* to the first windward heat-exchanging core portion 11*a* are connected to each other with the through-hole 132 provided to the partition member 131 in the second windward tank portion 13. Hence, in the present embodiment, the through-hole 132 forms a connection channel.

In the refrigerant evaporator 1 of the present embodiment described above, the through-hole 132 to let the second refrigerant distribution portion 13*b* and the first refrigerant distribution portion 13*a* communicate with each other is provided to the partition member 131 in the second windward tank portion 13. Hence, a liquid phase refrigerant is able to migrate between the second refrigerant distribution portion 13*b* and the first refrigerant distribution portion 13*a* via the through-hole 132.

The liquid phase refrigerant therefore migrates between the second refrigerant distribution portion 13*b* and the first refrigerant distribution portion 13*a* from the second refrigerant distribution portion 13*b* where a flow rate of the refrigerant is high to the first refrigerant distribution portion 13*a* where a flow rate of the refrigerant is low via the through-hole 132. Accordingly, a flow rate of the refrigerant flowing the first refrigerant distribution portion 13*a* increases and the refrigerator oil stagnating in the first refrigerant distribution portion 13*a* where a flow rate of the refrigerant is low can be flushed (forced to migrate) by the liquid phase refrigerant. Consequently, the refrigerator oil can be restricted from stagnating in the refrigerant evaporator 1, and hence a flow rate of the refrigerator oil circulating in the refrigeration cycle can be secured.

Figure 6:
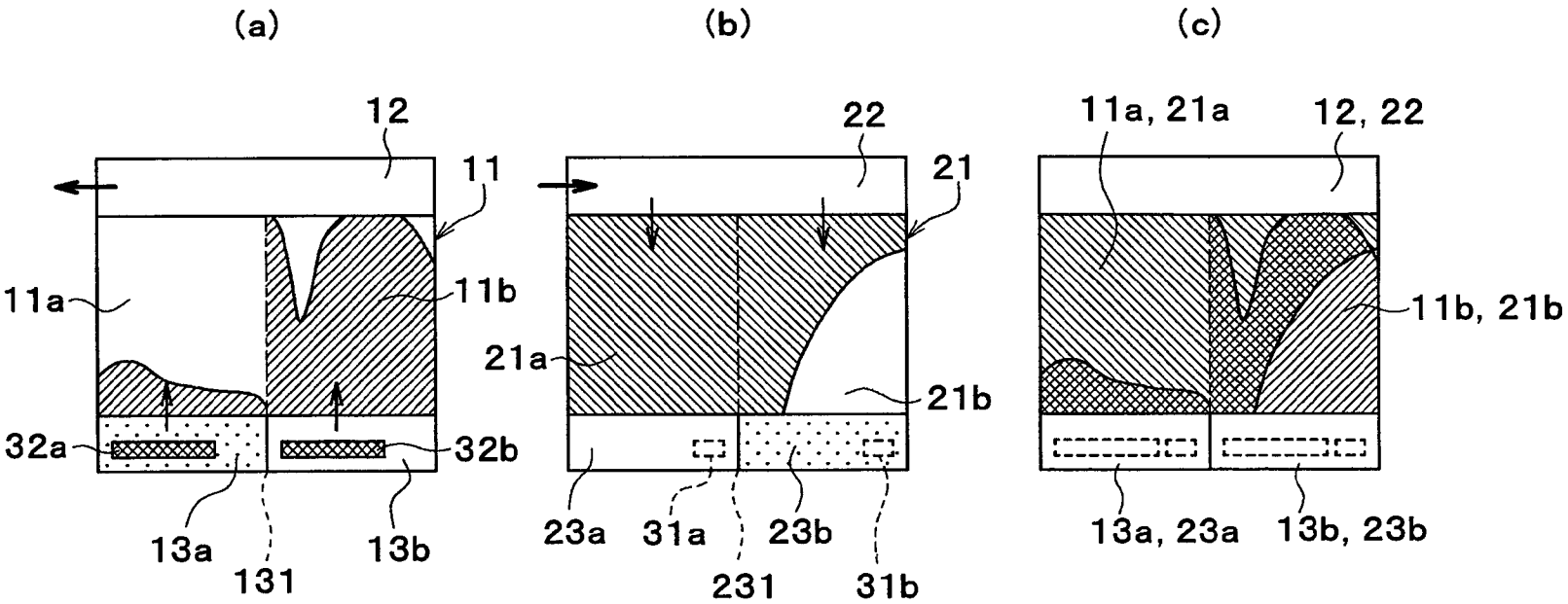
FIG. 6 is a view to describe distribution of liquid phase refrigerant flowing respective heat-exchanging core portions of a refrigerant evaporator of a comparative example.
Figure 7:
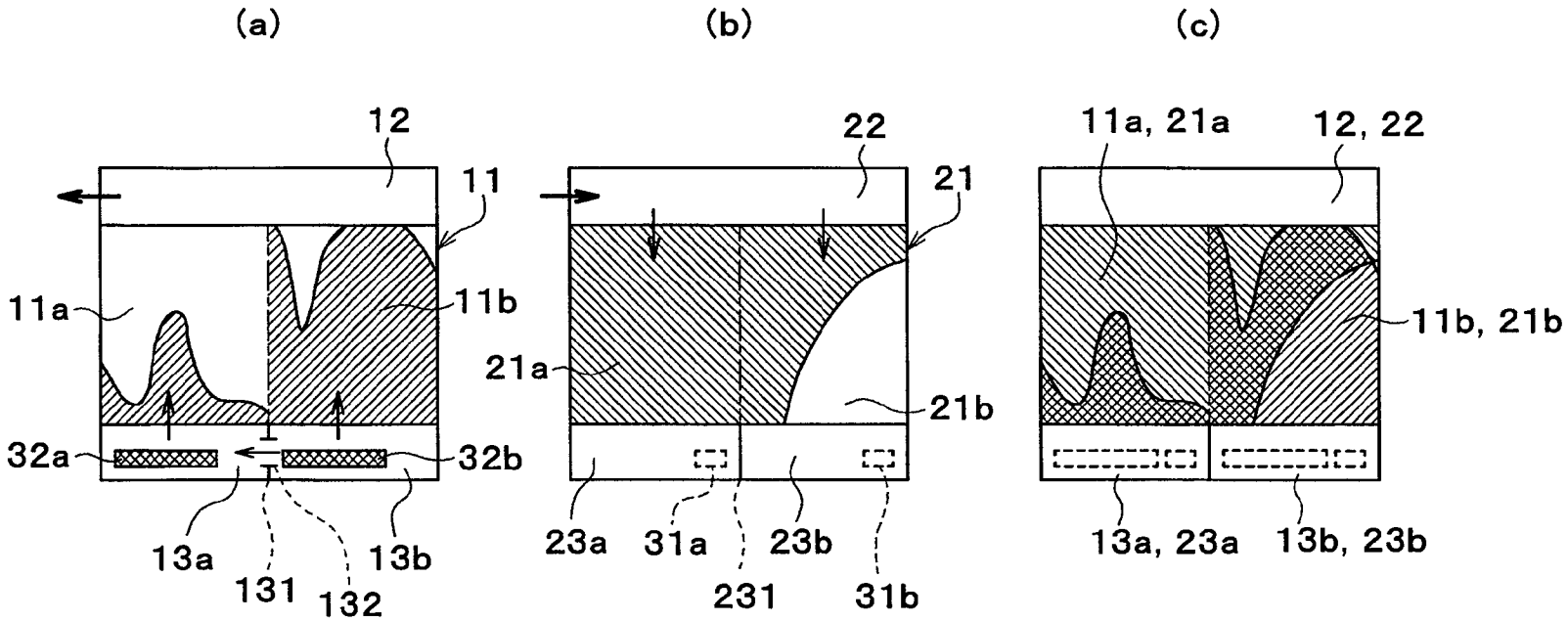
FIG. 7 is a view to describe distribution of liquid phase refrigerant flowing respective heat-exchanging core portions of the refrigerant evaporator according to the embodiment.

FIG. 6 is a view to describe distribution of liquid phase refrigerant flowing heat-exchanging core portions 11 and 21 of a refrigerant evaporator of a comparative example (in which a through-hole 132 is not provided to a partition member 131 in a second windward tank portion 13). FIG. 7 is a view to describe distribution of liquid phase refrigerant flowing the heat-exchanging core portions 11 and 21 of the refrigerant evaporator 1 according to the present embodiment.

FIG. 6(*a*) and FIG. 7(*a*) show distribution of the liquid phase refrigerant flowing the windward heat-exchanging core portion 11. FIG. 6(*b*) and FIG. 7(*b*) show distribution of the liquid phase refrigerant flowing the leeward heat-exchanging core portion 21. FIG. 6(*c*) and FIG. 7(*c*) show a synthesis of distributions of the liquid phase refrigerant flowing the respective heat-exchanging core portions 11 and 21. FIG. 6 and FIG. 7 show distributions of the liquid phase refrigerant when the refrigerant evaporator 1 is viewed in a direction indicted by an arrow Y of FIG. 1 (a direction opposite to the flow direction X of blown air), and shaded portions in the respective drawings represent a portion where the liquid phase refrigerant is present.

Firstly, distribution of the liquid phase refrigerant flowing the leeward heat-exchanging core portion 21 will be described. As shown in FIG. 6(*b*) and FIG. 7(*b*), the distributions are the same in the refrigerant evaporator of the comparative example and the refrigerant evaporator 1 of the present embodiment. A portion where the liquid phase refrigerant hardly flows (a hollow portion on the lower right in each drawing) is developed in a part of the second leeward heat-exchanging core portion 21*b*.

Regarding a distribution of the liquid phase refrigerant flowing the windward heat-exchanging core portion 11 in the refrigerant evaporator of the comparative example, as shown in FIG. 6(*a*), the liquid phase refrigerant hardly flows the first windward heat-exchanging core portion 11*a* in comparison with the second windward heat-exchanging core portion 11*b* in the windward heat-exchanging core portion 11.

As shown in FIG. 6, in the refrigerant evaporator of the comparative example, the refrigerator oil stagnates in the second refrigerant collection portion 23*b* and the first refrigerant distribution portion 13*a* (see dot-shaded portions in the drawings) that communicate, respectively, with the second leeward heat-exchanging core portion 21*b* and the first windward heat-exchanging core portion 11*a* where the liquid phase refrigerant hardly flows.

The following will describe a reason why a part of the refrigerator oil stagnates in the refrigerant evaporator of the comparative example.

A refrigerant channel A is defined by a refrigerant channel through which to pass a refrigerant flowing the heat-exchanging core portion of the first evaporation unit on one side in the width direction to the heat-exchanging core portion of the second evaporation unit on the other side in the width direction. A refrigerant channel B is defined by a refrigerant channel through which to pass a refrigerant flowing the heat-exchanging core portion of the first evaporation unit on the other side in the width direction to the heat-exchanging core portion of the second evaporation unit on the one side in the width direction. For example, of the refrigerant and the refrigerator oil, assume that 95% flows the refrigerant channel A and 5% flows the refrigerant channel B. Herein, because a flow rate of the refrigerant in the refrigerant channel B is so low that evaporation is completed at an early stage and the refrigerant turns to a gas phase refrigerant having a degree of superheat that does not contribute to heat exchange. The refrigerator oil dissolved in the refrigerant is separated in association with the evaporation phenomenon. When the evaporation phenomenon is completed while the refrigerant is flowing the heat-exchanging core portion of the first evaporation unit, it becomes difficult in the refrigerant channel B to let the refrigerator oil remaining in the lower tank portion flow up in the heat-exchanging core portion of the second evaporation unit and flow out to the outside.

When a part of the refrigerator oil remains in the refrigerant evaporator, a flow rate of the refrigerator oil circulating in the cycle is lowered. When the flow rate becomes low, compression efficiency is decreased and a durability life of the compressor is shortened due to internal abrasion of the compressor.

In an air conditioner for a vehicle provided with a refrigerating cycle equipped with a compressor of a fixed capacity, cooling capability varies with various factors, such as an engine speed and a temperature, a humidity, and a flow rate of air (blown air in the vehicle interior) passing through the refrigerant evaporator to be cooled.

Such an air conditioner may be configured so as to control the compressor to temporarily stop an operation (OFF) when detecting that the cooling capability is more than satisfying a cooling request from an occupant or frost formation is likely to occur in the refrigerant evaporator on the basis of detection signals from an internal temperature sensor that detects a vehicle interior temperature, a blown-out air temperature sensor that detects a temperature of blown-out air to be blown out into the vehicle interior, and so on. When the cooling capability becomes inadequate by stopping an operation of the compressor, the air conditioner controls the compressor to resume an operation (ON) to achieve a predetermined cooling state.

In the refrigerant evaporator of the comparative example, by configuring so as to interchange flow directions of the refrigerant in a pair of the communication portions coupling one tank portion of one evaporation unit and one tank portion of the other evaporation unit, a satisfactory temperature distribution can be realized across the entire surfaces of the heat-exchange core portions even when thermal loads differ between the width directions of the heat-exchanging core portions. A balance between flow rates of the refrigerant flowing the respective refrigerant channels A and B is adjusted according the thermal loads (amount of heat exchange, refrigerant pressure loss, and so on).

During an operation at a low flow rate, however, an extreme case where the entire refrigerant flows one of the two refrigerant channels whereas the refrigerant does not flow the other refrigerant channel at all may possibly occur. When the compressor stops an operation in such an extreme case, the liquid phase refrigerant remains little in the lower tank portion of the refrigerant channel where the liquid phase refrigerant does not flow at all. In short, an amount of the refrigerant remaining in the lower tank portions is different between the width directions of the heat-exchanging core portions.

When the compressor is activated later, due to a difference of amounts of the refrigerant remaining in the tank portions, the liquid phase refrigerant is distributed unevenly in the heat-exchanging core portion of the second evaporation unit immediately after the activation of the compressor. Hence, an unwanted temperature distribution is generated in blown air passing through the refrigerant evaporator. In a case where the refrigerant channel is not branched in a heat exchanger, a whole amount of the refrigerant flows without branching even when a flow rate is low. That is, an issue that the flow of the refrigerant is biased and a temperature distribution is consequently generated in the blown air is unique to the structure of the present disclosure in which the refrigerant channel is branched.

On the contrary, in the refrigerant evaporator 1 of the present embodiment, as is shown in FIG. 7(*a*), the liquid phase refrigerant in the second windward tank portion 13 flows into the first refrigerant distribution portion 13*a* from the second refrigerant distribution portion 13*b* via the through-hole 132 provided to the partition member 131 in the second windward tank portion 13. Hence, in comparison with the refrigerant evaporator of the comparative example, the liquid phase refrigerant more readily flows into the first windward heat-exchanging core portion 11*a* of the windward heat-exchanging core portion 11.

A flow rate of the refrigerant flowing the first refrigerant distribution portion 13*a* is increased by the liquid phase refrigerant that has flowed in from the second refrigerant distribution portion 13*b*. The refrigerant oil remaining in the first refrigerant distribution portion 13*a* is thus flushed by the liquid phase refrigerant.

As shown in FIG. 6(*c*) and FIG. 7(*c*), when the refrigerant evaporator of the comparative example and the refrigerant evaporator 1 of the present embodiment are viewed in the flow direction X of blown air, the liquid phase refrigerant flows the entire overlapping regions in the second windward heat-exchanging core portion 11*b* and the second leeward heat-exchanging core portion 21*b*.

Figure 8:
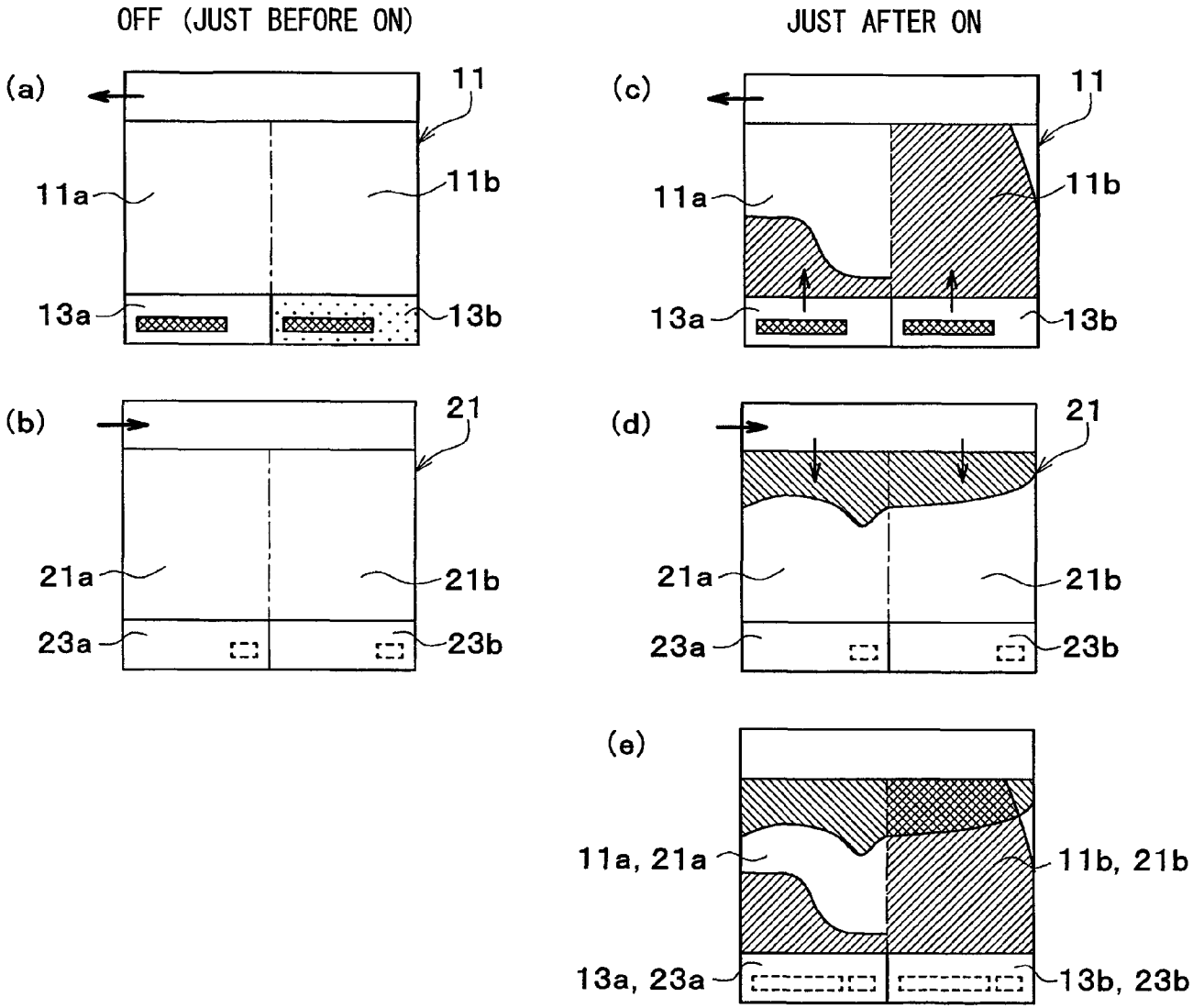
FIG. 8 is a view to describe distribution of liquid phase refrigerant flowing the respective heat-exchanging core portions when an operation of a compressor is switched ON from OFF in the refrigerant evaporator of the comparative example.
Figure 9:
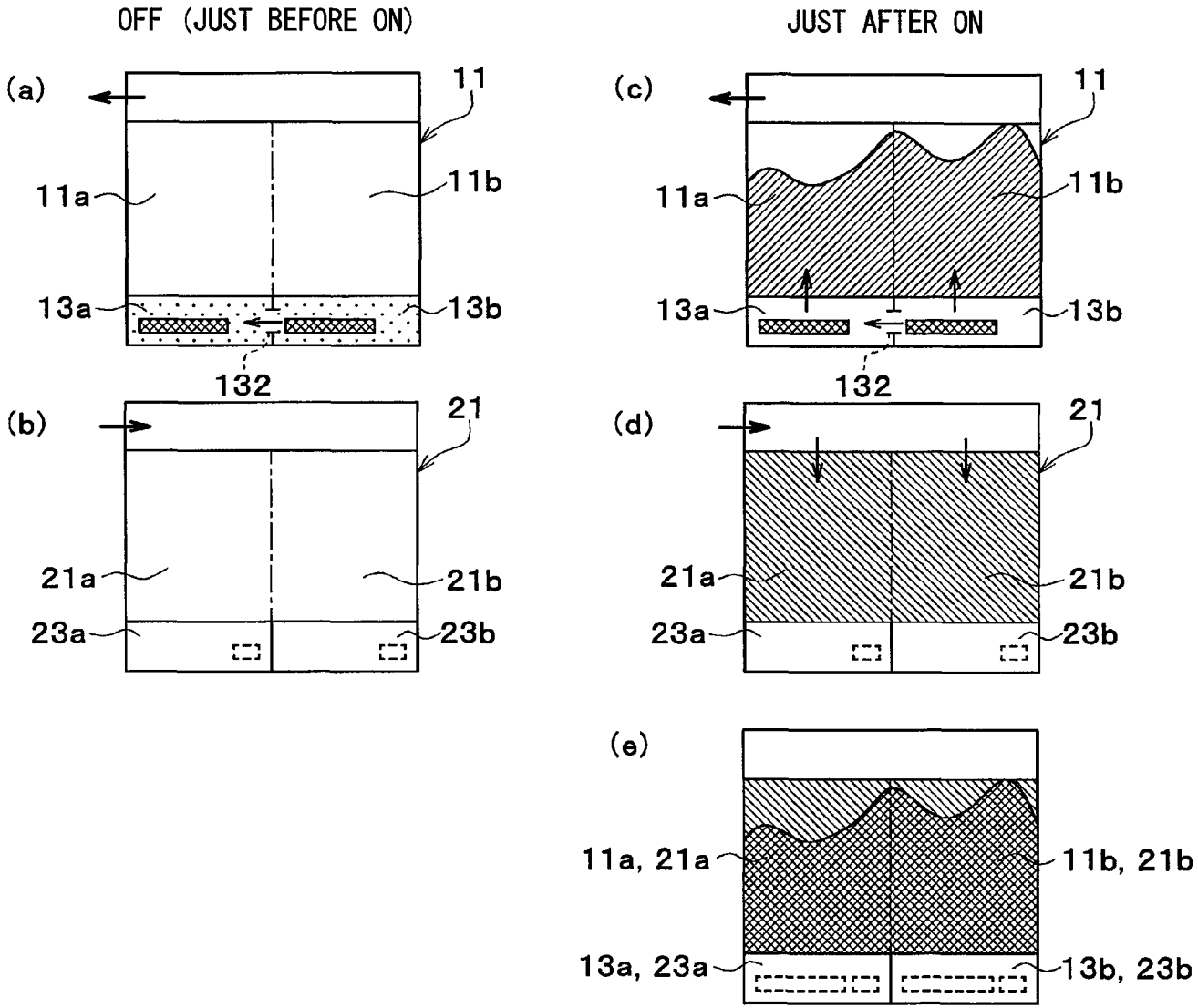
FIG. 9 is a view to describe distribution of liquid phase refrigerant flowing the respective heat-exchanging core portions when an operation of a compressor is switched ON from OFF in the refrigerant evaporator according to the embodiment.

FIG. 8 is a view to describe distribution of the liquid phase refrigerant flowing the heat-exchanging core portions 11 and 21 when an operation of the compressor is switched ON from OFF in the refrigerator evaporator of the comparative example (in which the through-hole 132 is not provided to the partition member 131 in the second windward tank portion 13). FIG. 9 is a view to describe distribution of the liquid phase refrigerant flowing the heat-exchanging core portions 11 and 21 when an operation of the compressor is switched ON from OFF in the refrigerator evaporator 1 of the present embodiment.

As has been described above, in the windward heat-exchanging core portion 11 of the refrigerant evaporator 1, the liquid phase refrigerant hardly flows the first windward heat-exchanging core portion 11*a* in comparison with the second windward heat-exchanging core portion 11*b*. Hence, as shown in FIG. 8(*a*), in the refrigerant evaporator of the comparative example, when an operation of the compressor is stopped, a large amount of the liquid phase refrigerant remains in the second refrigerant distribution portion 13*b* (see dot-shaded region in the drawing) whereas a small amount of the liquid phase refrigerant remains in the first refrigerant distribution portion 13*a* in the second windward tank portion 13.

When the compressor is activated in the state as above, as shown in FIG. 8(*c*), the liquid phase refrigerant hardly flows the first windward heat-exchanging core portion 11*a* of the windward heat-exchanging core portion 11 in the refrigerant evaporator of the comparative example.

As shown in FIG. 8(*c*), when the refrigerant evaporator of the comparative example is viewed in the flow direction X of blown air, a portion where the liquid phase refrigerant hardly flows (a hollow portion on the left in the drawing) is developed in a part of an overlapping region in the first windward heat-exchanging core portion 11*a* and the first leeward heat-exchanging core portion 21*a*.

Hence, in the refrigerant evaporator of the comparative example in which the liquid phase refrigerant is distributed as above, the blown air cannot be cooled sufficiently by merely letting the refrigerant absorb sensible heat from the blown air in a portion where the liquid phase refrigerant hardly flows. Consequently, an unwanted temperature distribution is generated in the blown air passing through the refrigerant evaporator.

On the contrary, in the refrigerant evaporator 1 of the present embodiment, as shown in FIG. 9(*a*), the liquid phase refrigerant in the second windward tank portion 13 flows into the first refrigerant distribution portion 13*a* from the second refrigerant distribution portion 13*b* via the through-hole 132 provided to the partition member 131 in the second windward tank portion 13. Hence, an amount of the liquid phase refrigerant remaining in the second refrigerant distribution portion 13*b* and an amount of the liquid phase refrigerant remaining in the first refrigerant distribution portion 13*a* become equal in the second windward tank portion 13.

In the refrigerant evaporator 1 of the present embodiment, when the compressor is activated in the state as above, as is shown in FIG. 9(*c*), the liquid phase refrigerant readily flows uniformly in the tube stacking direction in the respective windward heat-exchanging core portions 11*a* and 11*b* of the windward heat-exchanging core portion 11. That is to say, in the refrigerant evaporator 1 of the present embodiment, a biased distribution of the liquid phase refrigerant to the respective core portions 11*a* and 11*b* of the windward heat-exchanging core portion 11 is restricted.

As shown in FIG. 9(*e*), when the refrigerant evaporator 1 of the present embodiment is viewed in the flow direction X of blown air, the liquid phase refrigerant flows across the entire overlapping regions in the second windward heat-exchanging core portion 11*b* and the second leeward heat-exchanging core portion 21*b*.

In the refrigerant evaporator 1 of the present embodiment in which the liquid phase refrigerant is distributed as above, blown air can be cooled sufficiently because the refrigerant absorbs sensible heat and latent heat from the blown air in either the heat-exchanging core portion 11 or 21. Consequently, an inconvenience that a temperature distribution is generated in the blown air passing through the refrigerant evaporator 1 is restricted.

Because the expansion valve of the refrigerating cycle is closed immediately after the compressor is activated, the refrigerant does not flow into the leeward evaporation unit 20 immediately. Instead, the refrigerant in the windward evaporation unit 10 nearer to the compressor is drawn first. Hence, heat is hardly exchanged between the refrigerant and the blown air in the leeward evaporation unit 20 and heat is exchanged between the refrigerant and blown-out air in the windward evaporation unit 10. Accordingly, immediately after the compressor is activated, a distribution of the liquid phase refrigerant in the windward heat-exchanging core portion 11 of the windward evaporation unit 10 has a significant influence on a temperature distribution of the blown air passing through the refrigerant evaporator 1.

The refrigerant evaporator 1 of the present embodiment is configured in such a manner that when the refrigerant that has flowed the heat-exchanging core portions 21*a* and 21*b* of the leeward evaporation unit 20 is passed to the heat-exchanging core portions 11*a* and 11*b* of the windward evaporation unit 10 via the refrigerant interchanging portion 30, flows of the refrigerant are interchanged in the width direction (right-left direction) of the heat-exchanging core portions. The configuration as above can restrict a biased distribution of the liquid phase refrigerant in the heat-exchanging core portions 11*a*, 11*b*, 21*a*, 21*b*, and hence can restrict a temperature distribution in the blown air passing through the refrigerant evaporator 1.

However, the through-hole 132, which is provided to the partition member 131 in the second windward tank portion 13 in the present embodiment, may possibly reduce the temperature distribution restriction effect on the blown air described above depending on the configuration of the through-hole 132. By taking such a possibility into consideration, a type and a flow rate (flow speed) of a refrigerant used, a sectional area and a position of the through-hole 132, and so on are set appropriately. Consequently, the temperature distribution restriction effect on the blown air can be obtained and at the same time a flow rate securing effect on the refrigerant oil and a distribution deterioration restriction effect on the refrigerant immediately after activation of the compressor can be obtained.

The refrigerant in the refrigerant evaporator 1 is in a gas-liquid two-phase state and a flow pattern varies with a flow speed. For example, when R134a, which is a HFC-based refrigerant, is adopted as the refrigerant, the refrigerant forms a spray flow in a high-speed flow region and shifts to a gas-liquid mixed state. On the other hand, the refrigerant forms a stratified flow in a low-speed flow region and shifts to a gas-liquid separated state. Hence, assume that a sectional area of the through-hole 132 is the same, then a pressure loss when the refrigerant passes through the through-hole 132 varies with a flow pattern and a passing flow rate varies as well.

More specifically, a pressure loss is large with a spray flow and a pressure loss is small with a stratified flow. In the case of a stratified flow made up of a gas phase refrigerant and a liquid phase refrigerant in a gas-liquid separated state, in particular, a pressure loss is smaller in the liquid phase refrigerant. Hence, the liquid phase refrigerant is more likely to pass through the through-hole 132.

Hence, in a case where the refrigerant evaporator 1 is used under a condition where the refrigerant forms a spray flow, even when the sectional area of the through-hole 132 is increased, a pressure loss of the refrigerant passing through the through-hole 132 is large after all. A flow rate of the refrigerant passing through the through-hole 132 thus becomes low. Consequently, the temperature distribution restriction effect on the blown air can be maintained.

On the other hand, in a case where the refrigerant evaporator 1 is used under a condition where the refrigerant forms a stratified flow, a flow rate of the refrigerant passing through the through-hole 132 varies noticeably. Accordingly, specifications of the through-hole 132 are set by giving consideration to a balance among the temperature distribution restriction effect on the blown air, the flow rate securing effect on the refrigerant oil, and the distribution deterioration restriction effect on the refrigerant immediately after activation of the compressor.

The refrigerator oil and the liquid phase refrigerant readily remain in the second windward tank portion 13 on a lower side in a direction of gravitational force. Hence, a position at which to provide the through-hole 132 is set according to liquid levels of the refrigerator oil and the liquid phase refrigerant. Heights of the liquid levels of the refrigerator oil and the liquid phase refrigerant may be adjusted according to a sectional area of the second windward tank portion 13 or the like.

(Other Embodiment)

The present disclosure is not limited to the embodiment described above and can be modified in various manners as follows within the scope of the present disclosure.

The embodiment above has described a case where the through-hole 132 provided to the partition member 131 in the second windward tank portion 13 is adopted as the connection channel to connect the first refrigerant channel that introduces refrigerant from the first leeward heat-exchanging core portion 21*a* to the second windward heat-exchanging core portion 11*b* and the second refrigerant channel that introduces refrigerant from the second leeward heat-exchanging core portion 21*b* to the first windward heat-exchanging core portion 11*a* by way of example. However, the connection channel is not limited to the through-hole 132.

Figure 10:
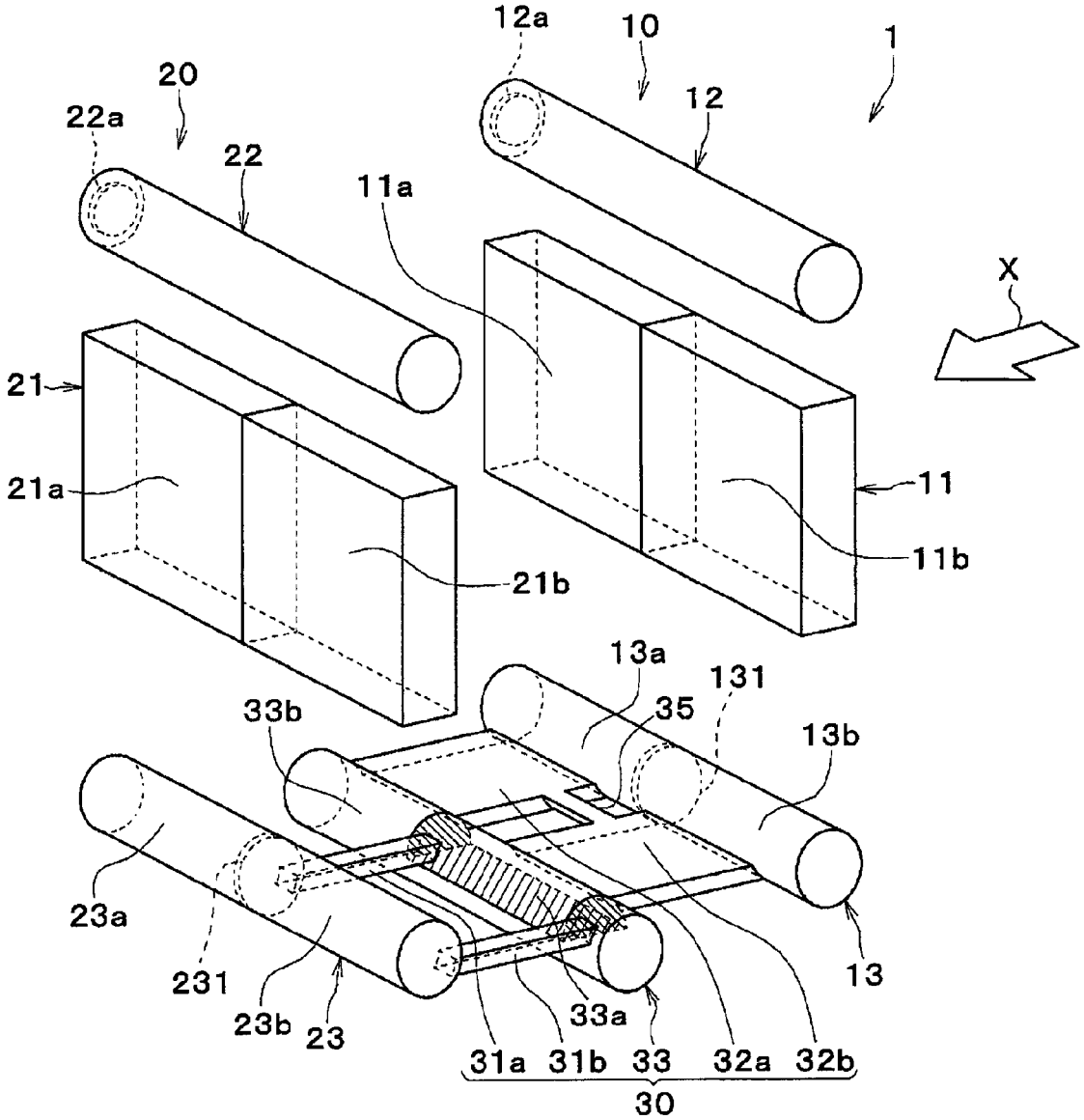
FIG. 10 is an exploded perspective view of a refrigerant evaporator according to other embodiment.

For example, as shown in FIG. 10, a connection portion 35 connecting the first distribution connector 32*a* and the second distribution connector 32*b* may be provided as the connection channel. Alternatively, a connection portion connecting the first collection connector 31*a* and the second collection connector 31*b* may be provided as the connection channel. Further, a communication hole to let the first refrigerant channel 33*a* communicate with the second refrigerant channel 33*b* may be provided in the intermediate tank portion 33. Moreover, a communication hole to let the first refrigerant collection portion 23*a* communicate with the second refrigerant collection portion 23*b* may be provided in the second leeward tank portion 23.

The embodiment above has described a case where the refrigerant interchanging portion 30 is formed of a pair of the collection connectors 31*a* and 31*b*, a pair of the distribution connectors 32*a* and 32*b*, and the intermediate tank portion 33 by way of example. However, the refrigerant interchanging portion 30 is not limited to the example above. For example, the refrigerant interchanging portion 30 may be configured so as to directly connect the connectors 31*a* and 32*b* and also directly connect the connectors 31*b* and 32*a* by omitting the intermediate tank portion 33.

When the refrigerant evaporator 1 is viewed in the flow direction X of blown air, the first windward heat-exchanging core portion 11*a* and the first leeward heat-exchanging core portion 21*a* are disposed to fully overlap, and the second windward heat-exchanging core portion 11*b* and the second leeward heat-exchanging core portion 21*b* are disposed to fully overlap in the above embodiment. However, the present disclosure is not limited to the above case. It may be configured in such a manner that when the refrigerant evaporator 1 is viewed in the flow direction X of blown air, the first windward heat-exchanging core portion 11*a* and the first leeward heat-exchanging core portion 21*a* are disposed to partially overlap, and the second windward heat-exchanging core portion 11*b* and the second leeward heat-exchanging core portion 21*b* are disposed to partially overlap.

It is preferable to dispose the windward evaporation unit 10 upstream of the leeward evaporation unit 20 in the flow direction X of blown air in the refrigerant evaporator 1. However, the present disclosure is not limited to the above configuration and the windward evaporation unit 10 may be disposed downstream of the leeward evaporation unit 20 in the flow direction X of blown air.

The heat-exchanging core portion 11, 21 is defined by the multiple tubes 111, 211 and the fins 112, 212 in the above embodiment. However, the present disclosure is not limited to the above case and the heat-exchanging core portion 11, 21 may be made up of only the multiple tubes 111, 211. In a case where the heat-exchanging core portion 11, 21 is made up of the multiple tubes 111, 211 and the fins 112, 212, the fins 112, 212 are not limited to corrugate fins and plate fins may be adopted instead.

The refrigerant evaporator 1 is applied to the refrigerating cycle in the air conditioner for a vehicle in the above embodiment. However, the present disclosure is not limited to the above case and the refrigerant evaporator 1 may be applied to a refrigerating cycle used in, for example, a water heater instead.

What is claimed is:

1. A refrigerant evaporator that exchanges heat between fluid flowing outside to be cooled and refrigerant, comprising:

a first evaporation unit and a second evaporation unit disposed in series in a flow direction of the fluid, wherein each of the first evaporation unit and the second evaporation unit has a heat-exchanging core portion in which a plurality of tubes are stacked, the refrigerant flowing through the plurality of tubes, the heat-exchanging core portion of the first evaporation unit has a first core portion defined by a part of the plurality of tubes and a second core portion defined by a rest of the plurality of tubes, and the heat-exchanging core portion of the second evaporation unit has a third core portion defined by a part of the plurality of tubes opposing at least a part of the first core portion in the flow direction of the fluid and a fourth core portion defined by a part of the plurality of tubes opposing at least a part of the second core portion in the flow direction of the fluid;

a first refrigerant channel that introduces the refrigerant from the first core portion to the fourth core portion;

a second refrigerant channel that introduces the refrigerant from the second core portion to the third core portion; and a connection channel to connect the first refrigerant channel and the second refrigerant channel with each other, wherein the connection channel is configured to allow a liquid-phase refrigerant flowing through the first refrigerant channel to flow into the second refrigerant channel through the connection channel, the connection channel is configured to allow a liquid-phase refrigerant flowing through the second refrigerant channel to flow into the first refrigerant channel through the connection channel, and the connection channel is defined between the first refrigerant channel and the second refrigerant channel that are channels in parallel with each other.

2. The refrigerant evaporator according to claim 1, wherein:

each of the first evaporation unit and the second evaporation unit has a pair of tank portions connected to both ends of the plurality of tubes to collect or distribute the refrigerant flowing inside the plurality of tubes;

of a pair of the tank portions of the first evaporation unit, one tank portion includes a first refrigerant collection portion to collect the refrigerant from the first core portion and a second refrigerant collection portion to collect the refrigerant from the second core portion;

of a pair of the tank portions of the second evaporation unit, one tank portion includes a first refrigerant distribution portion to distribute the refrigerant to the third core portion and a second refrigerant distribution portion to distribute the refrigerant to the fourth core portion;

the first evaporation unit and the second evaporation unit are coupled via a first communication portion that introduces the refrigerant in the first refrigerant collection portion to the second refrigerant distribution portion and a second communication portion that introduces the refrigerant in the second refrigerant collection portion to the first refrigerant distribution portion; and the connection channel is configured such that one of the first refrigerant collection portion, the second refrigerant distribution portion, and the first communication portion communicate with one of the second refrigerant collection portion, the first refrigerant distribution portion, and the second communication portion.

3. The refrigerant evaporator according to claim 2, wherein:

the communication portion lets the second refrigerant distribution portion communicate with the first refrigerant distribution portion.

4. The refrigerant evaporator according to claim 1, wherein:

the liquid-phase refrigerant moves between the first refrigerant channel and the second refrigerant channel from one refrigerant channel where a flow rate of the refrigerant is high to the other refrigerant channel where a flow rate of the refrigerant is low via the connection channel.

5. The refrigerant evaporator according to claim 1, wherein:

each of the first evaporator unit and the second evaporator unit has a tank portion, and the connection channel is disposed perpendicular to the flow direction of the fluid and parallel to the tank portion.

6. The refrigerant evaporator according to claim 1, wherein:

the first refrigerant channel is adjacent to the fourth core portion and the second refrigerant channel is adjacent to the third core portion.

7. The refrigerant evaporator according to claim 1, wherein:

a flow rate of the refrigerant flowing in the fourth core portion and a flow rate of the refrigerant flowing in the third core portion are equal immediately after compressor activation.

* * * * *